US005509457A

United States Patent [19]

Jellá

[11] Patent Number: 5,509,457

[45] Date of Patent: Apr. 23, 1996

[54] SECTIONAL DOOR AND PANEL THEREFOR

[75] Inventor: John F. Jellá, Tempe, Ariz.

[73] Assignee: Holmes-Halley Industries, Los Angeles, Calif.

[21] Appl. No.: 408,709

[22] Filed: Mar. 22, 1995

Related U.S. Application Data

[63] Continuation-in-part of Ser. No. 4,958, Dec. 30, 1992, abandoned.

[51] Int. Cl.[6] ..... E06B 3/12

[52] U.S. Cl. ..... 160/201; 160/232

[58] Field of Search ..... 160/201, 229.1, 160/206, 207, 213, 232, 235, 236, 40; 52/802.1, 802.11, 309.14, 455, 458

[56] References Cited

U.S. PATENT DOCUMENTS

| | | | |
|---|---|---|---|
| 2,863,503 | 12/1958 | Stroup | 160/201 |
| 2,993,572 | 7/1961 | Rich | 160/229.1 |
| 3,891,021 | 6/1975 | Geoffrey | 160/201 |
| 4,284,119 | 8/1981 | Martin et al. | 160/229.1 X |
| 4,995,441 | 2/1991 | Leist et al. | 160/229.1 |
| 5,016,700 | 5/1991 | Wegner et al. | 160/201 X |
| 5,060,711 | 10/1991 | Fimbell | 160/229.1 |

*Primary Examiner*—David M. Purol

*Attorney, Agent, or Firm*—Jordan M. Meschkow; Lowell W. Gresham; Mark M. Takahashi

[57] ABSTRACT

A sectional door panel for use in an overhead door assembly is provided. The sectional door panel includes a front panel, a rear panel, an insulating material between the front and rear panels, an upper edge integral to the front panel, a raised tongue formed in the upper edge, an upper rail integral to the upper edge, a lower edge integral to the front panel, a concave groove formed in the lower edge, and a lower rail integral to the lower edge. An overhead door assembly is also provided that utilizes a plurality of the sectional door panels.

30 Claims, 2 Drawing Sheets

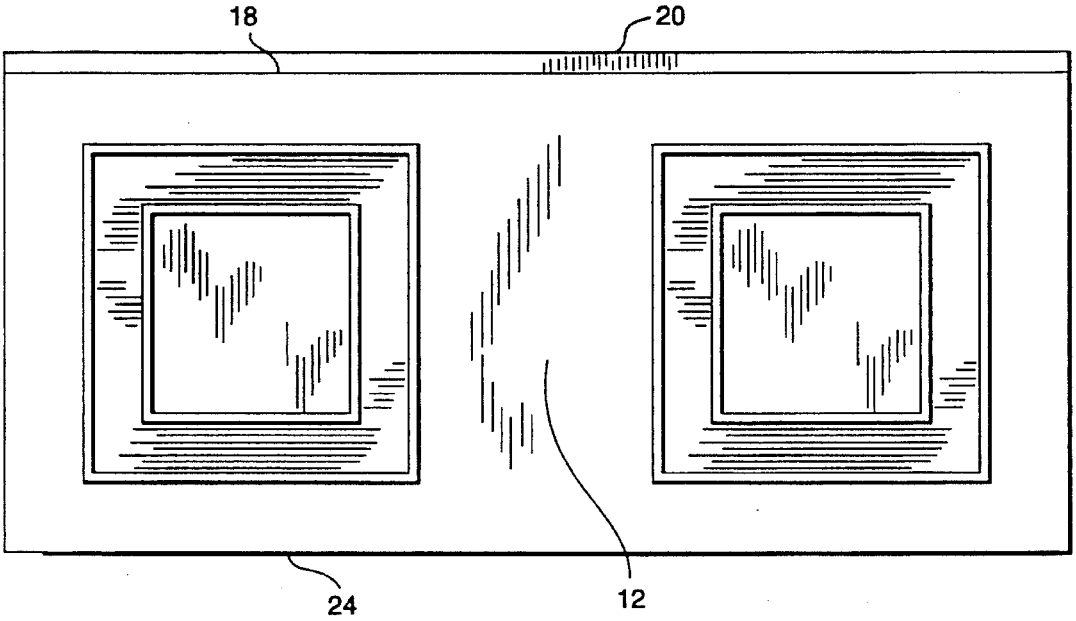
Fig. 4
Fig. 5
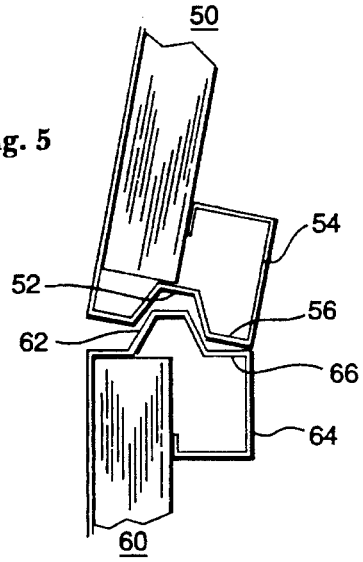
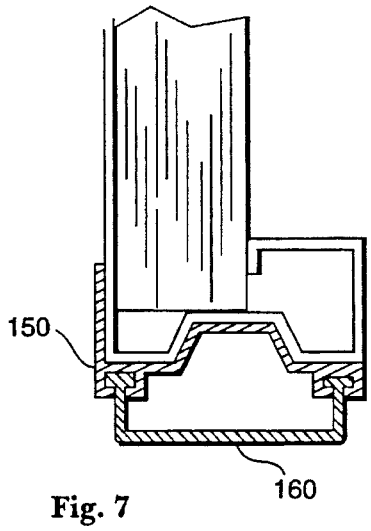
Fig. 7
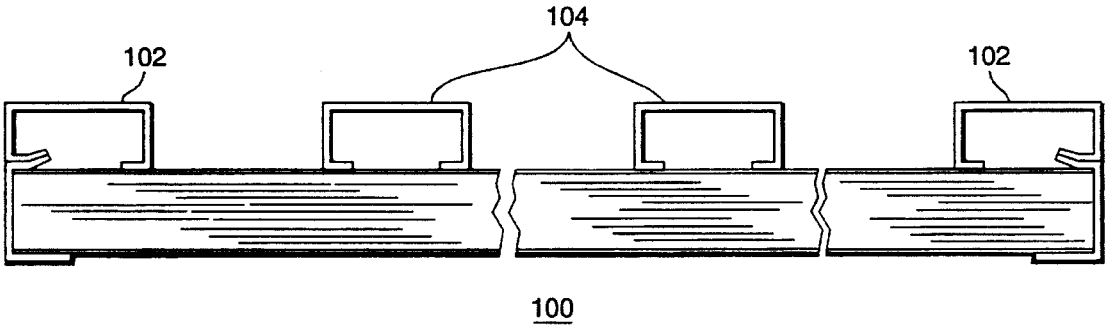
Fig. 6

SECTIONAL DOOR AND PANEL THEREFOR

CROSS-REFERENCE TO RELATED APPLICATION

This application is a continuation-in-part of my application, filed 30 Dec. 1992 and assigned Ser. No. 29/004,958, now abandoned.

FIELD OF THE INVENTION

The present invention relates generally to sectional doors. In particular, the present invention relates to track-guided sectional doors that include a plurality of hinged panels.

BACKGROUND OF THE INVENTION

Horizontally hinged doors of the overhead type are well known in the prior art. Such doors are typically constructed from several panels that are hinged together to allow the door to be raised from a vertical closed position to a horizontal open position overhead. To ensure a smooth transition from the vertical to horizontal orientation, each door panel is relatively thin in comparison to its length and width. Thus, such door panels are often structurally weak and susceptible to bending or flexing under normal loading conditions.

Known overhead door panels are usually formed from a thin sheet of metal such as aluminum. This type of construction results in a hinged door that is relatively loud during operation. In addition, metal doors are highly heat conductive, which causes thermal insulation problems. To alleviate the high noise levels and thermal conductivity, some manufacturers include insulation material within the door panels. However, such prior art door panels may still be structurally weak. Indeed, ordinary sandwich construction door panels may depend upon the adhesive bonding itself for their strength. As such, if the bonding should fail or weaken such prior art door panels may lose their strength and rigidity. Furthermore, other prior art door panels may be impractically thick or heavy due to added insulation layers or strengthening members.

The door panel orientation, hinge mounting position, or other design elements of prior art door panels may cause the overhead door to operate poorly. For example, the substantially rigid connection between older door panels and the corresponding hinges may cause the overhead door to rattle or shake during opening and closing. This can create noise in excess of the inherent mechanical noise associated with the operation of a sliding garage door.

SUMMARY OF THE INVENTION

Accordingly, it is an advantage of the present invention that a sectional door panel is provided that has improved structural strength and rigidity over traditional door panels.

Another advantage of the present invention is that an insulated sectional door panel is provided that has improved structural strength and rigidity over traditional insulated door panels.

A further advantage of the present invention is that an insulated sectional door panel is provided that maintains its structural strength and rigidity independently of the integrity of its internal construction.

Another advantage of the present invention is that a sectional door panel is provided that has improved structural strength and rigidity over traditional insulated door panels without adding to the panel thickness or weight, or adding reinforcing members to the panel.

An additional advantage of the present invention is that a sectional door panel is provided that moves smoother and more quietly than traditional door panels.

The above and other advantages of the present invention are carried out in one form by a sectional door panel having a front panel, a rear panel, an upper edge extending from the front panel, a raised tongue formed on the upper edge, a lower edge extending from the front panel, a concave groove formed on the lower edge, and a means for locating the rear panel.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 4 shows a top plan view of a door panel according to the present invention.

FIG. 5 is a side view of a tongue and groove junction between two door panels.

FIG. 6 shows a sectional view of a door panel with end and center stiles attached thereto, as viewed along line 6—6 in FIG. 1.

FIG. 7 shows a side view of a door panel with a lower endrail and a seal attached thereto.

DETAILED DESCRIPTION OF THE PREFERRED EMBODIMENT

Figure 1:
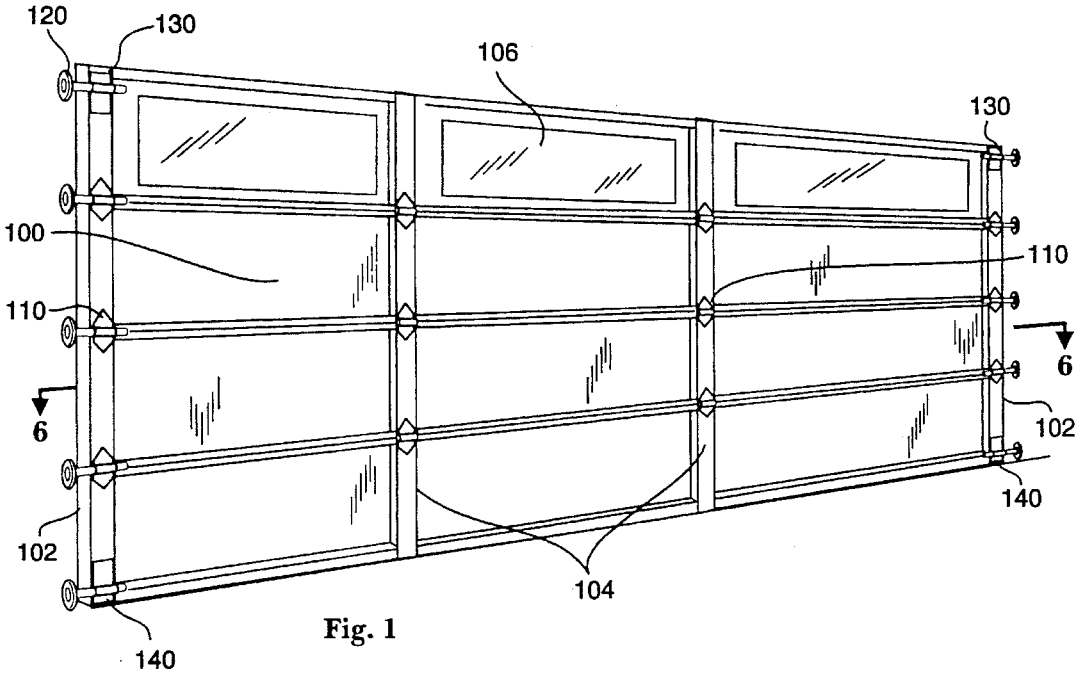
FIG. 1 shows a perspective view of an overhead door according to the present invention.

With reference to FIG. 1, an overhead door according to the present invention is illustrated as installed for use in a residential car garage. This type of garage door is commonly assembled from a plurality of sectional door panels 100 that extend horizontally across the door opening. Overhead doors of this type are horizontally hinged to allow sectional door panels 100 to make the vertical to horizontal transition.

Figure 2:
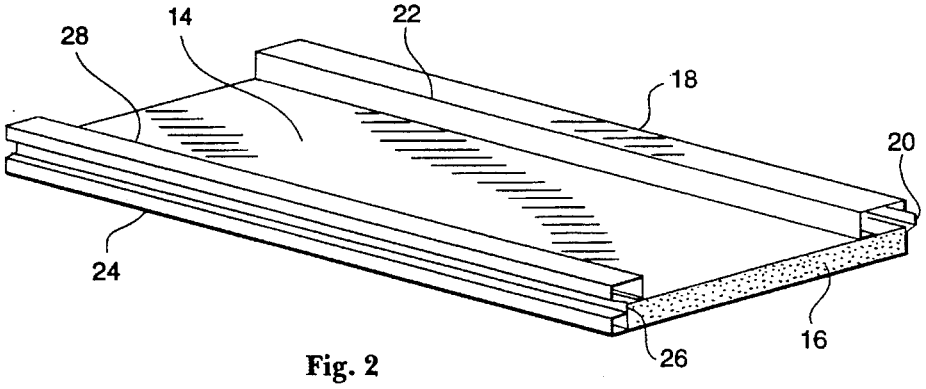
FIG. 2 shows a perspective view of a door panel according to a preferred embodiment of the present invention.
Figure 3:
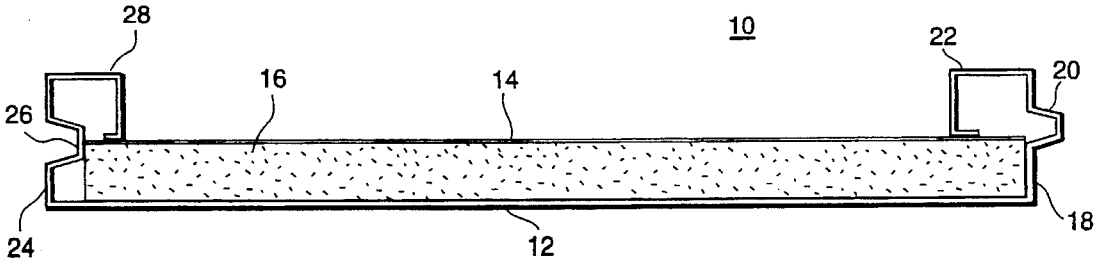
FIG. 3 is a side view of the door panel shown in FIG. 1.

With reference now to FIGS. 2–4, a preferred embodiment of sectional door panel 10 is illustrated in detail. Sectional door panel 10 includes a front panel 12, a rear panel 14, an insulating material 16, an upper edge 18, a raised tongue 20, an upper rail 22, a lower edge 24, a concave groove 26, and a lower rail 28.

According to the preferred embodiment, sectional door panel 10 is constructed such that front panel 12, upper edge 18, raised tongue 20, upper rail 22, lower edge 24, concave groove 26, and lower rail 28 are formed together as a one-piece assembly. Preferably, front panel 12 is formed from a steel sheet that provides adequate structural strength and durability while minimizing the weight of sectional door panel 10. According to the preferred embodiment, front panel 12 is formed from steel having a thickness ranging between 28 and 24 gauge. The length and height of sectional door panel 10 may vary to accommodate specific applications.

Typically, the exterior of front panel 12 is exposed to the environment. Accordingly, front panel 12 may be treated to minimize or prevent the damage that may be caused by wind, dust, rain, snow, and the like. For example, according to the preferred embodiment, front panel 12 is galvanized, coated with primer, painted, and baked to provide protection against rusting and corrosion. Additionally, the painted finish of sectional door panel 10 allows for easy washing and cleaning.

With specific reference to FIG. 4, the exterior of sectional door panel 10 is illustrated. In residential installations, a homeowner may desire to distinguish his or her home with a decorative pattern on the garage door. Accordingly, sectional door panel 10 may include a decorative texture embossed in front panel 12. Although FIG. 4 illustrates a typical design, front panel 12 may be embossed with any desired pattern during the manufacturing process.

Rear panel 14 is located behind front panel 12, and it substantially spans the length and width of sectional door panel 10. As shown in FIG. 3, the plane defined by rear panel 14 runs substantially parallel to the plane defined by front panel 12. According to one aspect of the present invention, rear panel 12 is attached to upper rail 22 and lower rail 28 such that the plane defined by rear panel 12 intersects raised tongue 20 and concave groove 26.

Rear panel 14 is preferably formed from a thin steel sheet, which creates a smooth surface on the interior of sectional door panel 10. According to the present invention, rear panel 14 is treated and painted as described above in relation to front panel 12.

According to one aspect of the present invention, sectional door panel 10 utilizes a sandwich construction to enclose insulating material 16 between front panel 12 and rear panel 14. As shown in FIG. 3, insulating material 16 substantially fills the space between front panel 12 and rear panel 14. As described previously, the plane defined by rear panel 14 is approximately aligned with raised tongue 20 .and concave groove 26. This configuration maintains the strength, rigidity, and insulating capacity of sectional door panel 10 without adding the weight associated with having insulation over the entire width of sectional door panel 10.

Insulating material 16 is preferably formed from a sheet of polystyrene. However, depending upon individual applications, materials having different insulating properties may be utilized instead of polystyrene. According to the preferred embodiment, insulating material 16 is laminated to both front panel 12 and rear panel 14 to form a structural bond. Preferably, a hot-melt adhesive is used in this laminating process. In addition to securing insulating material 16, sectional door panel 10 is structurally reinforced as a result of this bonding process. It should be appreciated that other techniques known to those skilled in this art, such as injection molding, may be utilized to provide insulating material 16 between front panel 12 and rear panel 14.

With continued reference to FIGS. 2–4, front panel 12 is shaped to form upper edge 18 and lower edge 24, as shown. According to the preferred embodiment of the present invention, upper edge 18 and lower edge 24 form raised tongue 20 and concave groove 26, respectively. After forming raised tongue 20 and concave groove 26, upper edge 18 and lower edge 24 both continue to extend behind the plane defined by rear panel 14. Raised tongue 20 and concave groove 26 are preferably located centrally between upper edge 18 and lower edge 24, respectively. According to the preferred embodiment, upper edge 18 and lower edge 24 continue to form upper rail 22 and lower rail 28, respectively. Upper rail 22 and lower rail 28 are both substantially J-shaped in cross section, and they both terminate and attach to rear panel 14.

Upper rail 22 and the rear portion of upper edge 18 form a substantially rectangular beam that runs across the top of sectional door panel 10. In similar fashion, lower rail 28 .and the rear portion of lower edge 24 form a substantially rectangular beam that runs across the bottom of sectional door panel 10. This configuration results in sectional door panel 10 having increased strength and rigidity over traditional door panels that have a uniform thickness.

With reference now to FIG. 5, a first door panel 50 and a second door panel 60 according to the present invention are illustrated as cooperating in a typical installation. As shown, a raised tongue 62 and a concave groove 52 are shaped to allow them to engage when first door panel 50 and second door panel 60 are in a vertically closed position. When closed, raised tongue 62 and concave groove 52 form a "seal" against rain, wind, and dirt. In addition, raised tongue 62 and concave groove 52 help to reduce lateral movement between first door panel 50 and second door panel 60.

With continued reference to FIG. 5, an upper rail 64, a lower rail 54, an upper edge 66, and a lower edge 56 form a substantially rectangular "beam" when first door panel 50 and second door panel 60 are in a vertically closed position. When assembled into a complete overhead door, these horizontal "beams" increase the structural rigidity and strength of the door.

With reference again to FIG. 3, raised tongue 20 and concave groove 26 are preferably offset from the plane defined midway between front panel 12 and rear panel 14. This feature allows a door assembled from a number of sectional door panels 10 to open and close smoothly, without binding or catching when sectional door panels 10 pivot. Referring back to FIG. 5, the rectangular cross sections formed by upper rail 64, lower rail 54, upper edge 66, and lower edge 56 flex and absorb vibrations like a spring when an overhead door assembly is in motion. Therefore, the rectangular members function as a damping mechanism that reduces the noise and vibration usually associated with the opening and closing of an overhead door.

Referring back to FIG. 1, a complete overhead door assembly according to the present invention is illustrated. The overhead door includes a plurality of sectional door panels 100, a plurality of hinges 110, a plurality of rollers 120, a plurality of top fixtures 130, and a plurality of bottom brackets 140.

According to the present invention, each of door panels 100 are as described above, with the following additions or modifications. Each of door panels 100 also includes a plurality of end stiles 102 and a plurality of center stiles 104. In addition, a plurality of windows 106 may be included in one of door panels 100. Preferably, the lowest of door panels 100 also includes an endrail 150 and a seal 160 (as shown in FIG. 7).

According to the preferred embodiment, the assembled overhead door includes sectional door panels 100 having end stiles 102 and center stiles 104 that serve both as mounting locations for hinges 110 and to increase the structural stability of the overhead door. Stiles 102, 104 run between the upper and lower rails of sectional door panels 100. With reference now to FIG. 6, a cross section of a door panel 100 is illustrated with right end stiles 102 and center stiles 104 attached thereto. Although FIG. 6 shows two center stiles 104, sectional door panel 100 may have more or less than two center stiles 104 depending upon its specific length. End stiles 102 and center stiles 104 are attached to sectional door panel 100 with an adhesive. In addition, the stiles also include extended portions (not shown) that are attached to the upper and lower rails of sectional door panel 100 with rivets. As shown in FIG. 6, end stiles 102 also surround the edges of sectional door panel 100 to give it a finished appearance.

With reference back to FIG. 1, a typical overhead door installation includes at least one sectional door panel 100 that has windows 106 formed within it. Typically, windows 106 are formed from plexiglass panels that are sealed within sectional door panel 100. Although only one design is illustrated, many variations can be manufactured according to individual preferences.

A typical overhead door installation also includes a seal or insulator, mounted at the bottom of the door, which is used keep out water, dirt and wind. Referring now to FIG. 7, endrail 150 and seal 160 are shown attached to a sectional door panel according to the present invention. Endrail 150 is preferably formed from an aluminum or steel extrusion, and shaped to match the contour of the concave groove of the door panel. According to the present invention, endrail 150 is affixed to the door panel using adhesive, glue, or epoxy. Seal 160 is shaped so that it slidably fits into endrail 150, as shown in FIG. 7. Preferably, seal 160 is formed from a pliable material such as vinyl or rubber, and shaped so that it compresses against the ground when the overhead door is closed.

Referring back to FIG. 1, an overhead door according to the present invention includes hinges 110 located between the individual sectional door panels 100. Hinges 110 are mounted to end stiles 102 and center stiles 104. Hinges 110 are preferably formed from steel, and are known to those skilled in this art.

A preferred overhead door additionally includes top fixtures 130 and bottom brackets 140, as shown in FIG. 1. Top fixtures 130 are attached to the upper corners of the highest sectional door panel, and bottom brackets 140 are attached to the lower corners of the lowest sectional door panel.

According to one aspect of the present invention, rollers 120 are utilized to guide the overhead door along a C-channelled track (not shown). Preferably, rollers 120 are attached to hinges 110, top fixtures 130, and bottom brackets 140, all of which are located at the edges of the overhead door assembly. Hinges 110, top fixtures 130, and bottom brackets 140 are well known in this art, and are configured to receive and secure rollers 120. Rollers 120 are common assemblies also known to those skilled in the art.

In summary, the present invention provides a sectional door panel that includes structural improvements over the prior art, without adding to the panel thickness or weight. The present invention also provides an insulated sectional door panel that maintains its strength and rigidity independently of the integrity of its internal construction. In addition, the present invention provides a sectional door panel that operates smoother and more quietly than traditional door panels.

The above description is of preferred embodiments of the present invention, and the invention is not limited to the specific embodiments described and illustrated. For example, the shapes and sizes of specific elements described may vary according to particular applications. Also, the number of sectional door panels, stiles, hinges, and windows may vary depending upon the desired size of the overhead door. Furthermore, other variations and modifications will be evident to those skilled in this art, and such variations and modifications are intended to be included within the spirit and scope of the invention, as expressed in the following claims.

What is claimed is:

1. A sectional door panel comprising:

a front panel;

a rear panel located behind said front panel;

an upper edge extending from said front panel;

a raised tongue formed across the length of said upper edge;

a lower edge extending from said front panel;

a concave groove formed across the length of said lower edge, wherein said raised tongue of a first sectional door panel is engagable with said concave groove of a second sectional door panel; and a means for locating said rear panel such that the plane defined by said rear panel intersects said raised tongue and said concave groove.

2. A sectional door panel according to claim 1, further comprising an insulating material located between said front panel and said rear panel.

3. A sectional door panel according to claim 1, wherein said raised tongue and said concave groove are located approximately midway along the width of said upper edge and said lower edge, respectively.

4. A sectional door panel according to claim 1, wherein said means for locating comprises:

an upper rail integral to said upper edge, wherein said upper rail has a substantially J-shaped cross section and is contiguous with said rear panel; and a lower rail integral to said lower edge, wherein said lower rail has a substantially J-shaped cross section and is contiguous with said rear panel.

5. A sectional door panel according to claim 4, wherein said front panel, said upper edge, said upper rail, said lower edge, and said lower rail are formed as an integral assembly.

6. A sectional door panel according to claim 1, wherein said front panel is embossed with a pattern.

7. A sectional door panel according to claim 1, further comprising at least one window formed therein.

8. A sectional door panel according to claim 1, further comprising a means for sealing located on said lower edge.

9. A sectional door panel according to claim 8, wherein said means for sealing comprises:

a lower endrail attached to said lower edge; and a seal attached to said lower endrail.

10. A sectional door panel according to claim 1, further comprising:

a right end;

a left end;

a right end stile attached to said right end and located between said upper edge and said lower edge;

a left end stile attached to said left end and located between said upper edge and said lower edge; and at least one center stile attached to said rear panel and located between said upper edge and said lower edge.

11. A sectional door panel comprising:

a front panel;

a rear panel located behind said front panel;

an insulating material located between said front panel and said rear panel;

an upper edge integral to said front panel, extending behind said rear panel;

a raised tongue formed across the length of said upper edge;

an upper rail integral to said upper edge, wherein said upper rail has a substantially J-shaped cross section and is contiguous with said rear panel;

a lower edge integral to said front panel, extending behind said rear panel;

a concave groove formed across the length of said lower edge, wherein said raised tongue of a first sectional door panel is engagable with said concave groove of a second sectional door panel; and a lower rail integral to said lower edge, wherein said lower rail has a substantially J-shaped cross section and is contiguous with said rear panel;

wherein said upper rail and said lower rail locate said rear panel such that the plane defined by said rear panel intersects said raised tongue and said concave groove.

12. A sectional door panel according to claim 11, wherein said raised tongue and said concave groove are located approximately midway along the width of said upper edge and said lower edge, respectively.

13. A sectional door panel according to claim 11, wherein said front panel is embossed with a pattern.

14. A sectional door panel according to claim 11, further comprising at least one window formed therein.

15. A sectional door panel according to claim 11, further comprising a means for sealing located on said lower edge.

16. A sectional door panel according to claim 15, wherein said means for sealing comprises:

a lower endrail attached to said lower edge; and a seal attached to said lower endrail.

17. A sectional door panel according to claim 11, further comprising:

a right end;

a left end;

a right end stile attached to said right end and located between said upper edge and said lower edge;

a left end stile attached to said left end and located between said upper edge and said lower edge; and at least one center stile attached to said rear panel located between said upper edge and said lower edge.

18. An overhead door comprising:

a plurality of sectional door panels, each having
- a front panel,
- a rear panel located behind said front panel,
- an upper edge extending from said front panel,
- a raised tongue formed across the length of said upper edge,
- a lower edge extending from said front panel,
- a concave groove formed across the length of said lower edge, wherein said raised tongue of a first sectional door panel is engagable with said concave groove of a second sectional door panel, and
- a means for locating said rear panel such that the plane defined by said rear panel intersects said raised tongue and said concave groove;

a plurality of hinges pivotally coupling said sectional door panels together; and a means for guiding said sectional door panels along a track.

19. An overhead door according to claim 18, wherein each of said sectional door panels further comprises an insulating material located between said front panel and said rear panel.

20. An overhead door according to claim 18, whereby in each of said sectional door panels said raised tongue and said concave groove is located approximately midway along the width of said upper edge and said lower edge, respectively.

21. A sectional door panel according to claim 18, whereby in each of said sectional door panels said means for locating comprises:

an upper rail integral to said upper edge, wherein said upper rail has a substantially J-shaped cross section and is contiguous with said rear panel; and a lower rail integral to said lower edge, wherein said lower rail has a substantially J-shaped cross section and is contiguous with said rear panel.

22. An overhead door according to claim 21, whereby in each of said sectional door panels said front panel, said upper edge, said upper rail, said lower edge, and said lower rail are formed as an integral assembly.

23. An overhead door according to claim 18, wherein at least one of said front panels is embossed with a pattern.

24. An overhead door according to claim 18, further comprising at least one window formed within at least one of said sectional door panels.

25. An overhead door according to claim 18, wherein the lowest of said sectional door panels further comprises a means for sealing located on said lower edge.

26. An overhead door according to claim 25, wherein said means for sealing comprises:

a lower endrail attached to said lower edge; and a seal attached to said lower endrail.

27. An overhead door according to claim 18, wherein each of said sectional door panels further comprises:

a right end;

a left end;

a right end stile attached to said right end and located between said upper edge and said lower edge;

a left end stile attached to said left end and located between said upper edge and said lower edge; and at least one center stile attached to said rear panel and located between said upper edge and said lower edge.

28. An overhead door according to claim 27, wherein said hinges are attached to said right end stiles, said left end stiles, and said center stiles.

29. An overhead door according to claim 18, wherein said means for guiding comprises a plurality of rollers.

30. An overhead door according to claim 18, wherein the highest of said sectional door panels further comprises a top right fixture attached to said right end stile proximate to said upper edge, and a top left fixture attached to said left end stile proximate to said upper edge; and the lowest of said sectional door panels further comprises a bottom right bracket attached to said right end stile proximate to said lower edge, and a bottom left bracket attached to said left end stile proximate to said lower edge.

* * * * *